US009140081B2

(12) United States Patent
Telfer et al.

(10) Patent No.: US 9,140,081 B2
(45) **Date of Patent: *Sep. 22, 2015**

(54) SYSTEM FOR CIRCUMFERENTIALLY ALIGNING A DOWNHOLE LATCH SUBSYSTEM

(71) Applicant: Halliburton Energy Services, Inc., Houston, TX (US)

(72) Inventors: Stuart Alexander Telfer, Stonehaven (GB); Espen Dahl, Rio de Janeiro (BR); David Joe Steele, Arlington, TX (US); Lester Barett Dupler, Providence Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/170,583

(22) Filed: Feb. 1, 2014

(65) Prior Publication Data

US 2014/0144617 A1 May 29, 2014

Related U.S. Application Data

(62) Division of application No. 13/945,808, filed on Jul. 18, 2013, now Pat. No. 8,678,097.

(51) Int. Cl.

| | |
|---|---|
| ***E21B 23/02*** | (2006.01) |
| ***E21B 23/12*** | (2006.01) |
| ***E21B 23/03*** | (2006.01) |
| ***E21B 7/06*** | (2006.01) |

(52) U.S. Cl.

CPC ..... *E21B 23/002* (2013.01); *E21B 7/061* (2013.01); *E21B 23/02* (2013.01); *E21B 23/03* (2013.01)

(58) Field of Classification Search

CPC ..... E21B 17/08; E21B 43/119; E21B 23/02; E21B 17/046; E21B 17/06; E21B 23/00; E21B 23/06; E21B 33/0407; E21B 43/14; E21B 23/002; E21B 7/061; E21B 23/03

See application file for complete search history.

(56) References Cited

U.S. PATENT DOCUMENTS

| | | | | |
|---|---|---|---|---|
| 5,871,046 | A | 2/1999 | Robison | |
| 6,012,527 | A * | 1/2000 | Nitis et al. | 166/313 |
| 6,202,746 | B1 | 3/2001 | Vandenberg | |
| 6,935,428 | B2 | 8/2005 | McGlothen | |
| 7,207,390 | B1 | 4/2007 | Pratt | |
| 2002/0023757 | A1 | 2/2002 | George et al. | |
| 2012/0103687 | A1 | 5/2012 | Saurer | |
| 2012/0267093 | A1 | 10/2012 | Zimmerman et al. | |

OTHER PUBLICATIONS

International Search Report and Written Opinion, KIPO, PCT/US2012/059308, Jun. 25, 2013.

* cited by examiner

*Primary Examiner* — Yong-Suk (Philip) Ro

(57) ABSTRACT

A system for circumferentially aligning a downhole latch subsystem in a wellbore. The system includes an outer tool assembly including a latch coupling having a latch profile and a slot subassembly having an axially extending slot profile. An inner tool assembly is positionable within the outer tool assembly. The inner tool assembly includes a latch assembly having a plurality of latch keys and an orienting subassembly having a plurality orienting keys. In operation, after axial alignment of the orienting subassembly with the slot subassembly, rotation of the orienting subassembly causes operable engagement of at least one orienting key with the slot profile and, thereafter, axial alignment of the latch assembly with the latch coupling causes operable engagement of the latch keys with the latch profile.

13 Claims, 9 Drawing Sheets

28
10
26
12
20
18
22
16
24
30
32
34
36
44
42
46
38
40
14

SYSTEM FOR CIRCUMFERENTIALLY ALIGNING A DOWNHOLE LATCH SUBSYSTEM

CROSS-REFERENCE TO RELATED APPLICATIONS

This application is a divisional application of co-pending application Ser. No. 13/945,808, filed Jul. 18, 2013, which claims the benefit under 35 U.S.C. §119 of the filing date of International Application No. PCT/US2012/059308, filed Oct. 9, 2012.

TECHNICAL FIELD OF THE INVENTION

This invention relates, in general, to equipment utilized in conjunction with operations performed in subterranean wells and, in particular, to a system for circumferentially aligning a latch assembly with a latch coupling in a subterranean well and a method for use of same.

BACKGROUND OF THE INVENTION

Without limiting the scope of the present invention, its background will be described in relation to forming a window in a casing string for a multilateral well, as an example.

In multilateral wells, it is common practice to drill a branch or lateral wellbore extending laterally from an intersection with a main or parent wellbore. Typically, once the casing string is installed and the parent wellbore has been completed, a deflection assembly such as a whipstock is positioned in the casing string at the desired intersection and then one or more mills are deflected laterally off of the whipstock to form a window through the casing sidewall.

In certain installations, it is desirable to drill the lateral wellbore in a predetermined direction from the parent wellbore such as out of the high side of the parent wellbore. In such installations, it is necessary to form the window at a predetermined circumferential orientation relative to the parent casing. In order to properly position and rotationally orient the whipstock such that the window is milled in the desired direction, a latch assembly associated with the whipstock is anchored into and rotationally oriented within a latch coupling interconnected in the casing string. The latch assembly typically includes a plurality of spring operated latch keys, each of which having an anchoring and orienting profile that is received in a latch profile formed internally within the latch coupling. In this manner, when the latch keys of the latch assembly are operatively engaged with the latch profile of the latch coupling, the latch assembly and the equipment associate therewith are axially and circumferentially anchored and rotationally oriented in the desired direction within the casing string.

It has been found, however, that in certain well installations such as deep or extended reach wells, rotationally securing a latch assembly within a latch coupling may be difficult. In typically practice, once the latch assembly is substantially on depth, the tool string carrying the latch assembly is slowly rotated and lowered into the well. This operation is intended to axially positioned the latch assembly in the latch coupling and rotationally align the latch assembly in the latch coupling in the desired circumferential orientation as indicated by a torque signal at the surface. In the aforementioned deep or extended reach wells, however, delay in the torque signal reaching the surface due to torsional flexibility and wind up of the worksting, for example, may result in over stressing the latch keys, release of the latch assembly from the latch coupling or other failure.

Accordingly, a need has arisen for an improved system for circumferentially aligning a downhole latch subsystem in a subterranean well. In addition, a need has arisen for such an improved system that is operable for use in deep or extended reach wells. Further, a need has arisen for such an improved system that does not risk over stressing the latch keys or releasing the latch assembly from the latch coupling during circumferential orientation.

SUMMARY OF THE INVENTION

The present invention disclosed herein is directed to a system for circumferentially aligning a downhole latch subsystem in a subterranean well. The system of the present invention is operable for use in deep and extended reach wells. In addition, the system of the present invention does not risk over stressing the latch keys or releasing the latch assembly from the latch coupling during circumferential orientation.

In one aspect, the present invention is directed to a system for circumferentially aligning a downhole latch subsystem in a wellbore. The system includes a casing string position in the wellbore. A latch coupling is interconnected in the casing string and has a latch profile. A slot subassembly is also interconnected in the casing string and has an axially extending slot profile. A tool string is run downhole and positioned within the casing string. A latch assembly is interconnected in the tool string and has a plurality of latch keys. An orienting subassembly is also interconnected in the tool string and has a plurality orienting keys. After axial alignment of the orienting subassembly with the slot subassembly, rotation of the orienting subassembly causes operable engagement of at least one orienting key with the slot profile and, thereafter, axial alignment of the latch assembly with the latch coupling causes operable engagement of the latch keys with the latch profile.

In one embodiment, the plurality of latch keys are circumferentially distributed about the latch assembly. In certain embodiments, each of the latch keys has axial anchor elements and circumferential anchor elements. In these embodiments, the circumferential anchor elements of each latch key may be different from the circumferential anchor elements of the other latch keys. In some embodiments, the plurality of orienting keys may be axially distributed along the orienting subassembly. In these embodiments, the orienting keys may become progressively circumferentially wider from the downhole end to the uphole end of the orienting subassembly. Also, in these embodiments, the orienting keys may have a tapered leading edge, a tapered trailing edge or both.

In another aspect, the present invention is directed to a system for circumferentially aligning a downhole latch subsystem in a wellbore. The system includes an outer tool assembly including a latch coupling having a latch profile and a slot subassembly having an axially extending slot profile. An inner tool assembly is positionable within the outer tool assembly and includes a latch assembly having a plurality of latch keys and an orienting subassembly having a plurality orienting keys. After axial alignment of the orienting subassembly with the slot subassembly, rotation of the orienting subassembly causes operable engagement of at least one orienting key with the slot profile and, thereafter, axial alignment of the latch assembly with the latch coupling causes operable engagement of the latch keys with the latch profile.

In one embodiment, the latch coupling and the slot subassembly are coupled together. In another embodiment, the latch assembly and the orienting subassembly are coupled together. In certain embodiments, the inner tool assembly includes a deflection assembly.

In a further aspect, the present invention is directed to a method for circumferentially aligning a downhole latch subsystem in a wellbore. The method includes positioning a casing string in the wellbore, the casing string including a latch coupling having a latch profile and a slot subassembly having an axially extending slot profile; running a tool string into the casing string, the tool string including a latch assembly having a plurality of latch keys and an orienting subassembly having a plurality orienting keys; axially aligning the orienting subassembly with the slot subassembly; rotating the tool string within the casing string to rotate the orienting subassembly relative to the slot subassembly; operably engaging at least one orienting key with the slot profile; and axially aligning the latch assembly with the latch coupling, thereby operably engaging the latch keys with the latch profile.

The method may also include providing coarse circumferential prealignment of the latch keys with the latch profile by operably engaging at least one orienting key with the slot profile; axially sliding at least some of the orienting key through the slot profile; providing fine circumferential prealignment of the latch keys with the latch profile and/or axially and circumferentially anchoring the latch keys within the latch profile.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
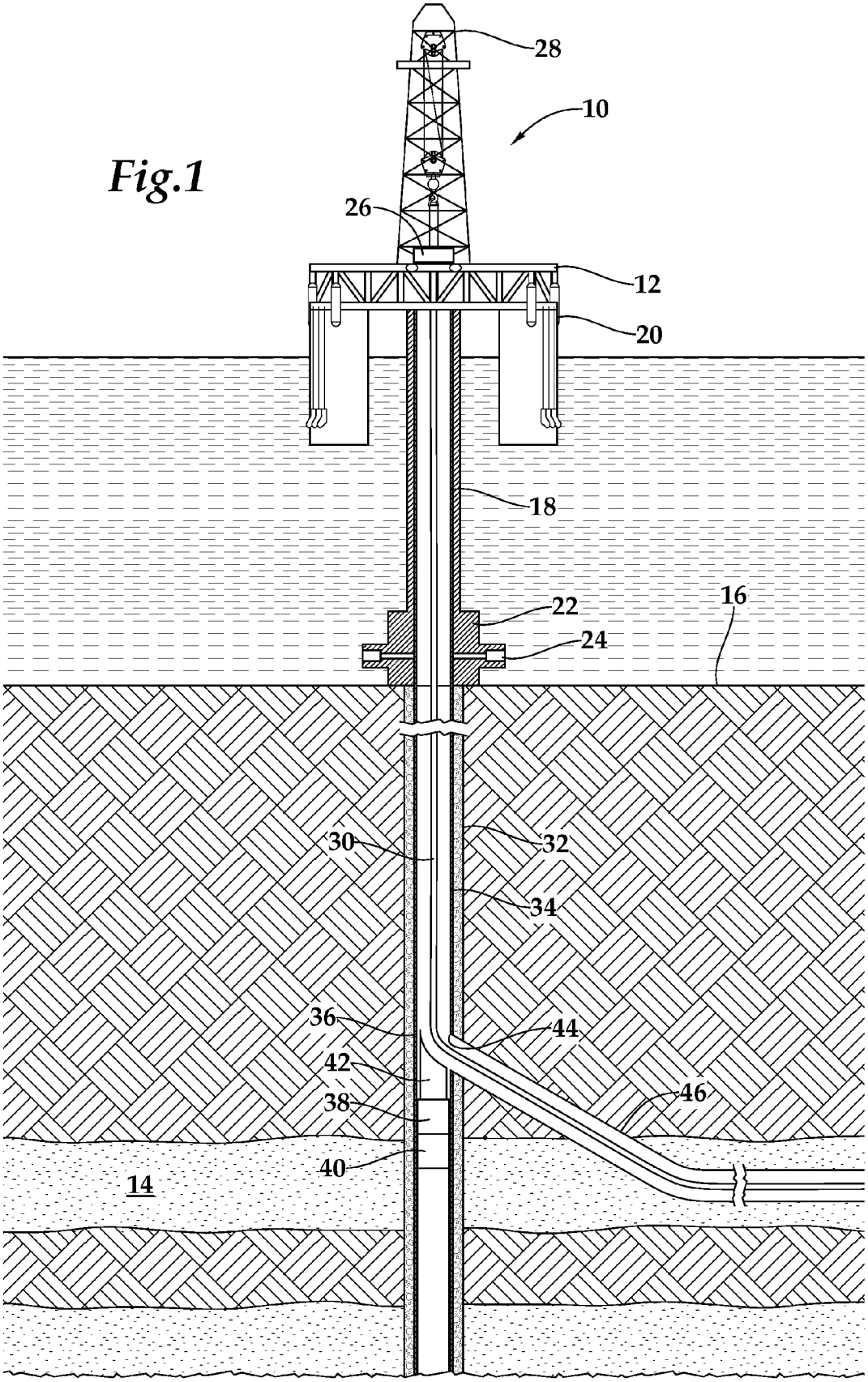
FIG. 1 is a schematic illustration of an offshore platform during multilateral wellbore construction following the operation of a system for circumferentially aligning a downhole latch subsystem in a subterranean well according to an embodiment of the present invention.

Referring to FIG. 1, a system for circumferentially aligning a downhole latch subsystem in a subterranean well is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings such as drill string 30. A main wellbore 32 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 34 is cemented within main wellbore 32. The term "casing" is used herein to designate a tubular string used in a wellbore or to line a wellbore. The casing may be of the type known to those skilled in the art as a "liner" and may be made of any material, such as steel or a composite material and may be segmented or continuous, such as coiled tubing.

Casing string 34 includes a window joint 36 interconnected therein. In addition, casing string 34 includes a latch coupling 38 and a slot assembly 40. Latch coupling 38 has a latch profile that is operably engagable with latch keys of a latch assembly (not visible in FIG. 1) such that the latch assembly may be axially anchored and rotationally oriented in latch coupling 38. Slot assembly 40 has a slot profile that is operably engagable with orienting keys of an orienting subassembly (not visible in FIG. 1). Operating the orienting subassembly such that the orienting keys operably engage the slot profile of slot assembly 40, prealigns the latch keys of latch assembly with the latch profile of latch coupling 38. Thereafter, axial shifting of the latch assembly into latch coupling 38 operably engages the latch keys of the latch assembly with the latch profile of latch coupling 38.

In the illustrated embodiment, when the orienting keys of the orienting subassembly have operably engaged the slot profile of slot assembly 40 and the latch keys of the latch assembly have operably engaged the latch profile of latch coupling 38, a deflection assembly depicted as whipstock 42 is positioned in a desired circumferential orientation relative to window joint 36 such that a window 44 can be milled, drilled or otherwise formed in window joint 36 in the desired circumferential direction. As illustrated, window joint 36 is positioned at a desired intersection between main wellbore 32 and a branch or lateral wellbore 46. The terms "branch" and "lateral" wellbore are used herein to designate a wellbore that is drilled outwardly from its intersection with another wellbore, such as a parent or main wellbore. A branch or lateral wellbore may have another branch or lateral wellbore drilled outwardly therefrom.

Even though FIG. 1 depicts the system for circumferentially aligning a downhole latch subsystem of the present invention in a vertical section of a main wellbore, it should be understood by those skilled in the art that the system of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Also, even though the system for circumferentially aligning a downhole latch subsystem of the present invention is depicted in a main wellbore having a single lateral wellbore extending therefrom, it should be understood by those skilled in the art that the system of the present invention can be used in main wellbores having multiple lateral wellbores each of which may utilize a system of the present invention for positioning and orienting a deflection assembly as each system of the present invention has a non restrictive inner diameter that enables non mating or non aligned latch assemblies to pass through a latch coupling.

Referring now to FIG. 2, a system for circumferentially aligning a downhole latch subsystem is depicted and generally designated 100. In the illustrated embodiment, a portion of system 100 is constructed as part of casing string 102. Casing string 102 includes a window joint 104 that is preferably formed from an easily millable or drillable material such as aluminum. Even though window joint 104 has been described as being formed from an easily millable or drillable material, those skilled in the art will understand that window joint 104 could alternatively be formed from standard casing or could have a pre-milled window formed therein. As illustrated, window joint 104 has a window 106 formed therethrough.

Figure 2A:
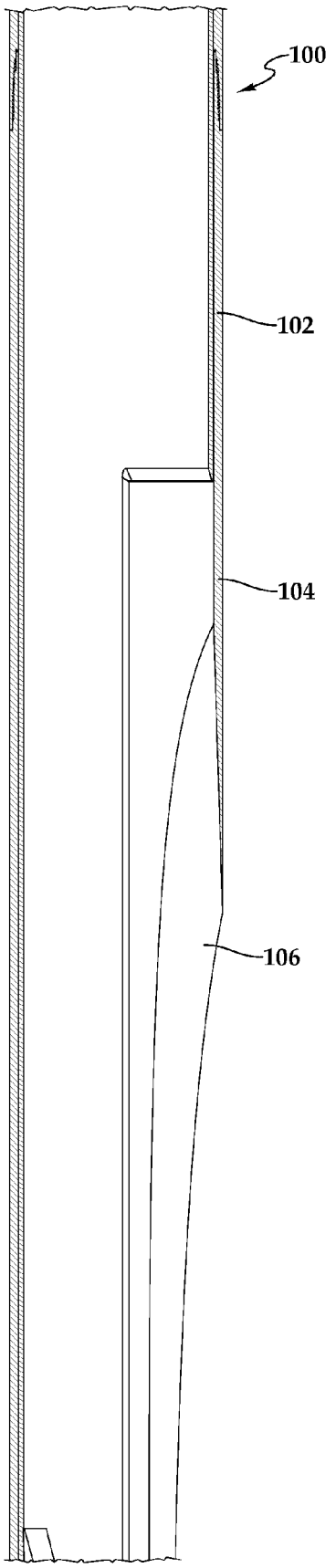
FIGS. 2A-2H are cross sectional views of consecutive axial sections of a system for circumferentially aligning a downhole latch subsystem in a subterranean well according to an embodiment of the present invention.
Figure 2B:
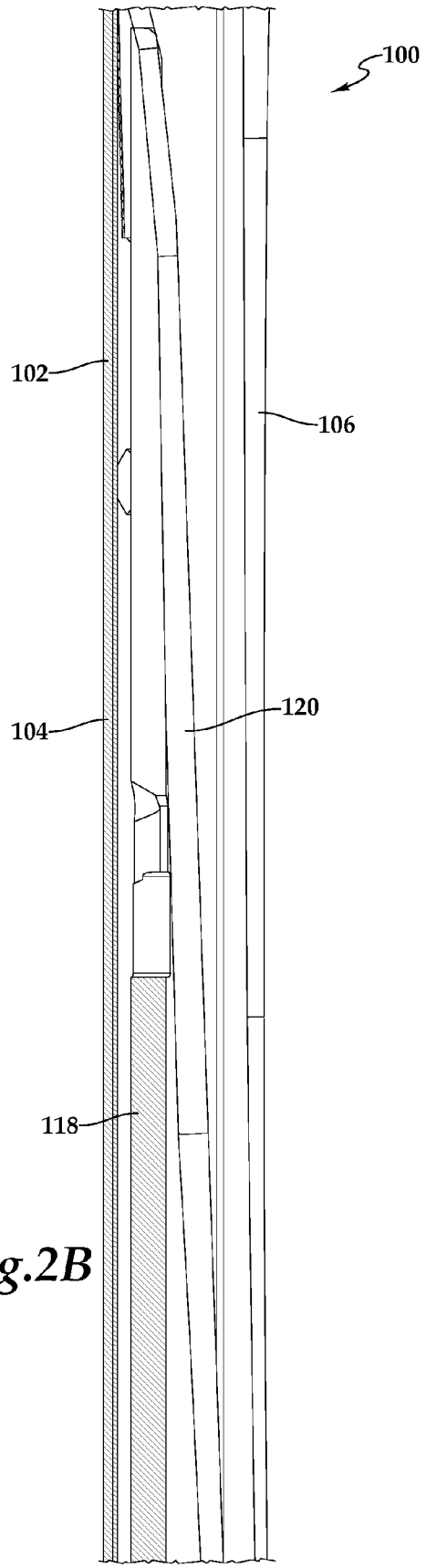
Figure 2C:
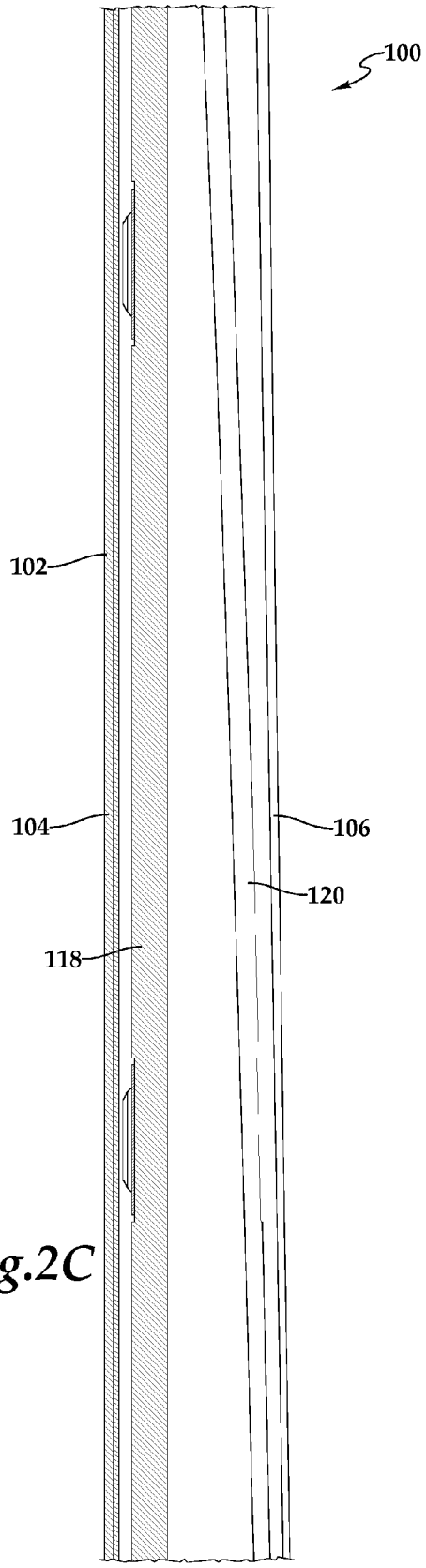
Figure 2D:
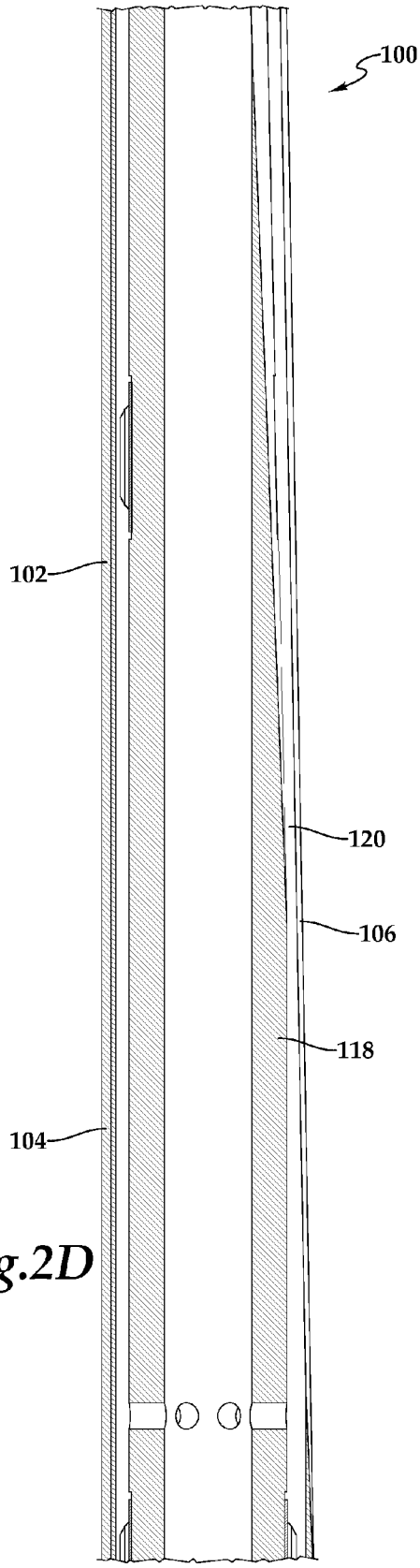
Figure 2E:
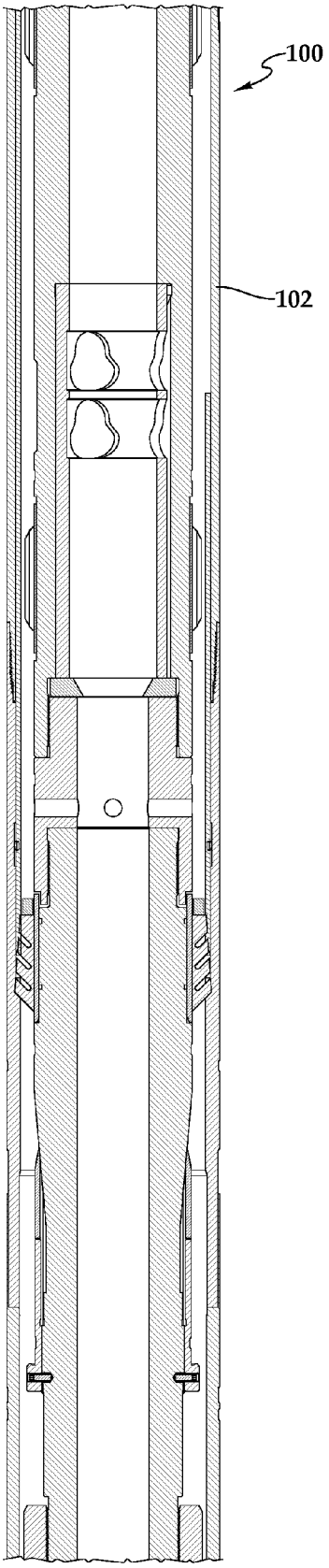
Figure 2F:
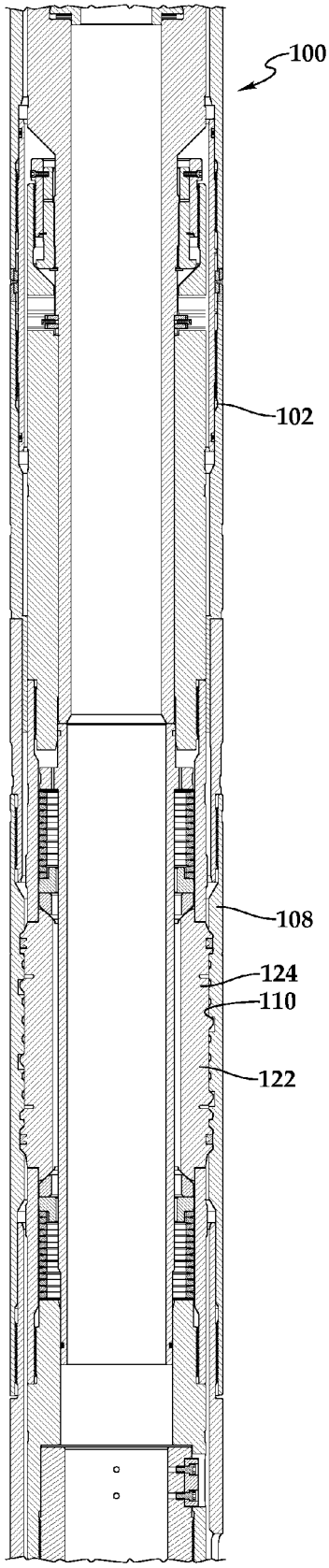
Figure 2G:
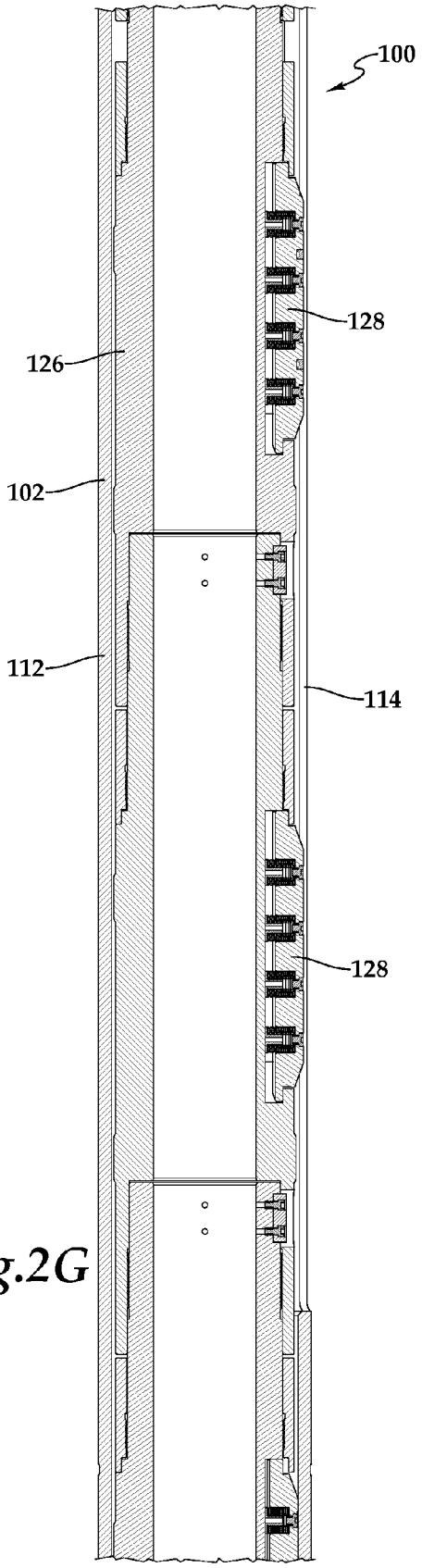
Figure 2H:
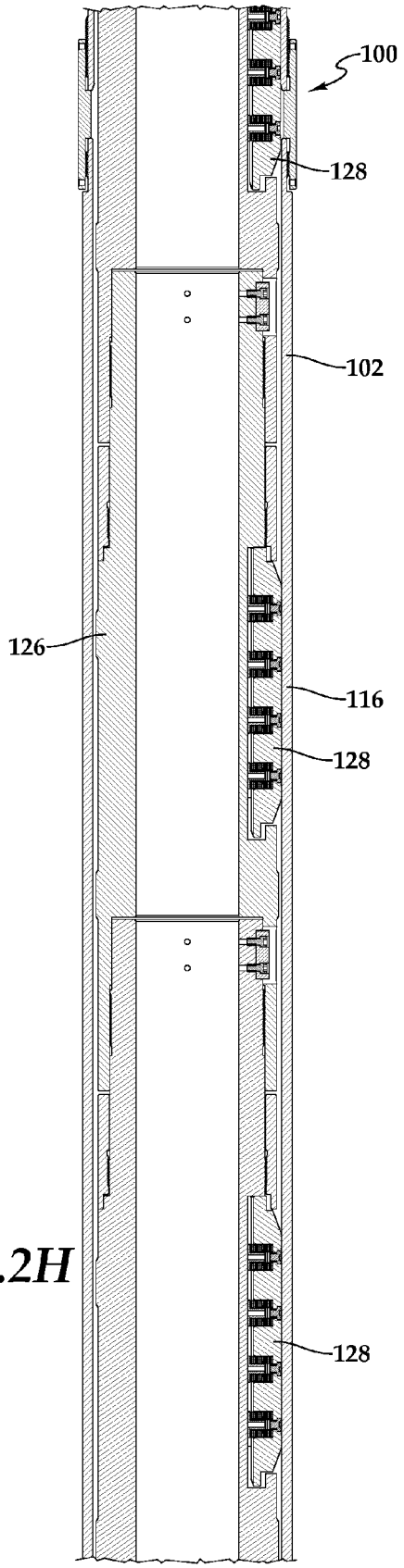

As best seen in FIG. 2F, casing string 102 includes a latch coupling 108 having a latch profile 110. As best seen in FIG. 2G, casing string 102 includes a slot subassembly 112 having a slot profile 114. Downhole thereof, casing string 102 includes any number of downhole tubulars, such as tubular 116, or other downhole tools. In the illustrated embodiment, window joint 104, latch coupling 108 and slot subassembly 112 are depicted as being interconnected within casing string 34 proximate one another, however, those skilled in the art will recognize that other tools or tubulars may alternatively be interconnected within casing string 102 between window joint 104, latch coupling 108 and slot subassembly 112. Together, latch coupling 108 and slot subassembly 112 may be referred to as an outer tool string that is operable to receive another tool string in the central pathway therethrough. As explained in further detail below, latch profile 110 preferably includes a plurality of circumferential alignment elements that are operable to receive latch keys of a latch assembly therein to locate the latch assembly in a particular circumferential orientation and axial position.

Disposed within casing string 102 is an inner tool string that is operable to be run into the outer tool string. In the illustrated embodiment, the inner tool string includes a deflection assembly depicted as whipstock 118 having a deflector surface 120 operable to direct a milling or drilling tool into the sidewall of window joint 104 to create a window 106 therethrough. Alternatively, in a completion embodiment, the deflection assembly would be a completion deflector operably to direct the desired completion equipment into the branch wellbore while allowing the desired equipment or fluid to travel in the main wellbore. Positioned downhole of whipstock 118, the inner tool string includes a latch assembly 122 having a plurality of latch keys 124 that are depicted as being operably engaged with latch profile 110 of latch coupling 108, as best seen in FIG. 2F. Positioned downhole of latch assembly 122, the inner tool string includes an orienting subassembly 126 having a plurality of orienting keys 128, the upper two of which are depicted as being operably engaged with slot profile 114 of slot subassembly 112, as best seen in FIG. 2G. In this configuration when orienting keys 128 of orienting subassembly 126 have operably engaged slot profile 114 of slot assembly 112 and latch keys 124 of latch assembly 122 have operably engaged latch profile 110 of latch coupling 108, deflector surface 120 of whipstock 118 is positioned in the desired circumferential orientation relative to window joint 104 allowing window 106 to be milled, drilled or otherwise formed in window joint 104 in a drilling embodiment.

Figure 3:
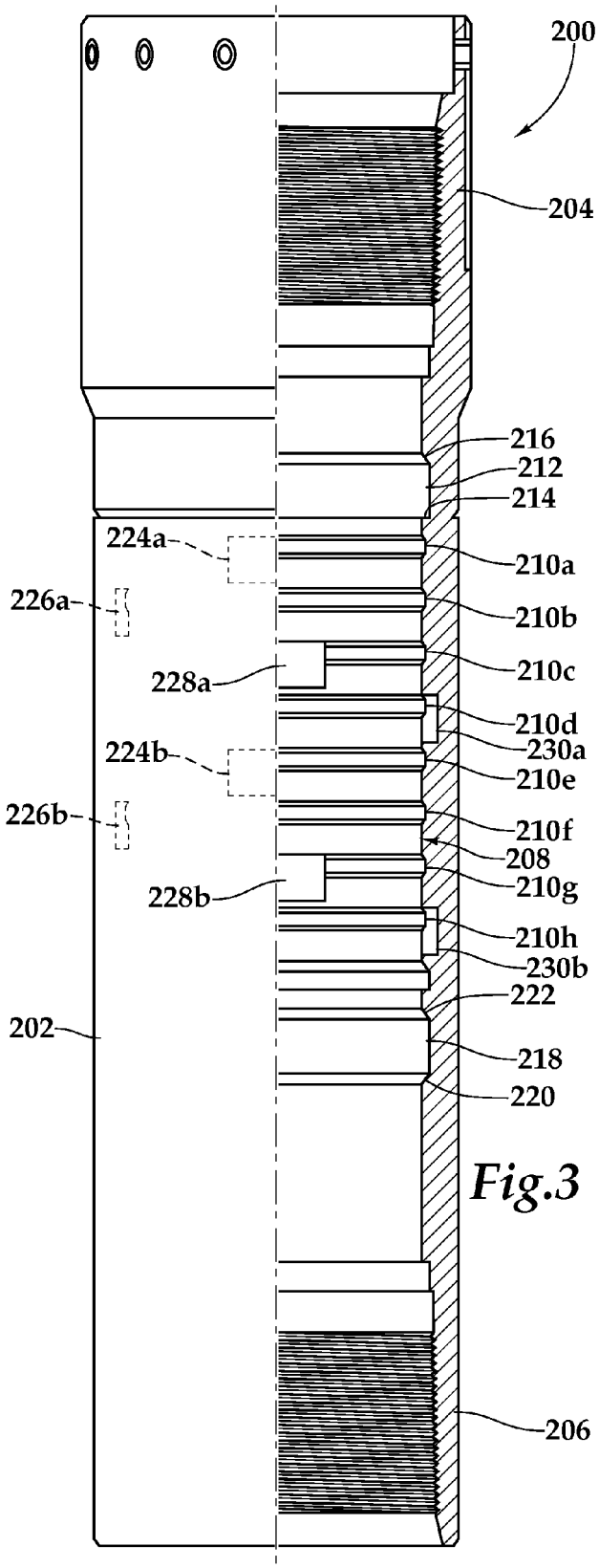
FIG. 3 is a quarter sectional view of a latch coupling for use in a system for circumferentially aligning a downhole latch subsystem in a subterranean well according to an embodiment of the present invention.

Referring next to FIG. 3, one embodiment of a latch coupling for use in a system for circumferentially aligning a downhole latch subsystem of the present invention is depicted and generally designated 200. Latch coupling 200 is representative of latch coupling 108 discussed above. It is noted that each latch coupling may have a unique latch profile that is different from the latch profile of another latch coupling. This enables selective engagement with a matching or mating set of latch keys in a desired latch assembly. Accordingly, latch coupling 200 is described herein to illustrate the type of elements and combination of elements that can be used to create any number of unique latch profiles as contemplated by the present invention.

Latch coupling 200 has a generally tubular body 202 having an upper connector 204 and a lower connector 206 suitable for connecting latch coupling 200 to other tools or tubulars via a threaded connection, a pinned connection or the like. Latch coupling 200 includes an internal latch profile 208 including a plurality of axially spaced apart recessed grooves 210*a*-210*h* that extend circumferentially about the inner surface of latch coupling 200. Preferably, recessed grooves 210*a*-210*h* extend about the entire circumferential internal surface of latch coupling 200. Latch profile 208 also includes an upper groove 212 having a lower square shoulder 214 and an upper angled shoulder 216. Latch profile 208 further includes a lower groove 218 having a lower angled shoulder 220 and an upper angled shoulder 222.

Latch profile 208 also has a plurality of circumferential alignment elements depicted as a plurality of recesses disposed within the inner surface of latch coupling 200. In the illustrated embodiment, there are four sets of two recesses that are disposed in different axial and circumferential positions or locations within the inner surface of latch coupling 200. For example, a first set of two recesses 224*a*, 224*b* (collectively recesses 224) are disposed within the inner surface of latch coupling 200 at substantially the same circumferential positions and different axial positions. A second set of two recesses 226*a*, 226*b* (collectively recesses 226) are disposed within the inner surface of latch coupling 200 at substantially the same circumferential positions and different axial positions. A third set of two recesses 228*a*, 228*b* (collectively recesses 228) are disposed within the inner surface of latch coupling 200 at substantially the same circumferential positions and different axial positions. A fourth set of two recesses 230*a*, 230*b* (collectively recesses 230) are disposed within the inner surface of latch coupling 200 at substantially the same circumferential positions and different axial positions.

As shown, recesses 226 are disposed within the inner surface of latch coupling 200 at a ninety degree circumferentially interval from recesses 224. Likewise, recesses 228 are disposed within the inner surface of latch coupling 200 at a ninety degree circumferentially interval from recesses 226. Finally, recesses 230 are disposed within the inner surface of latch coupling 200 at a ninety degree circumferentially interval from recesses 228. Preferably, recesses 224, 226, 228, 230 only partially extend circumferentially about the internal surface of latch coupling 200.

Latch profile 208 including the circumferential alignment elements creates a unique mating pattern operable to cooperate with the latch key profile associated with a desired latch assembly to axially and circumferentially anchor and orient, for example, a whipstock assembly in a particular desired circumferential orientation relative to the latch coupling. The specific profile of each latch coupling can be created by varying one or more of the elements or parameters thereof. For example, the thickness, number and relative spacing of the recesses can be altered.

Figure 4:
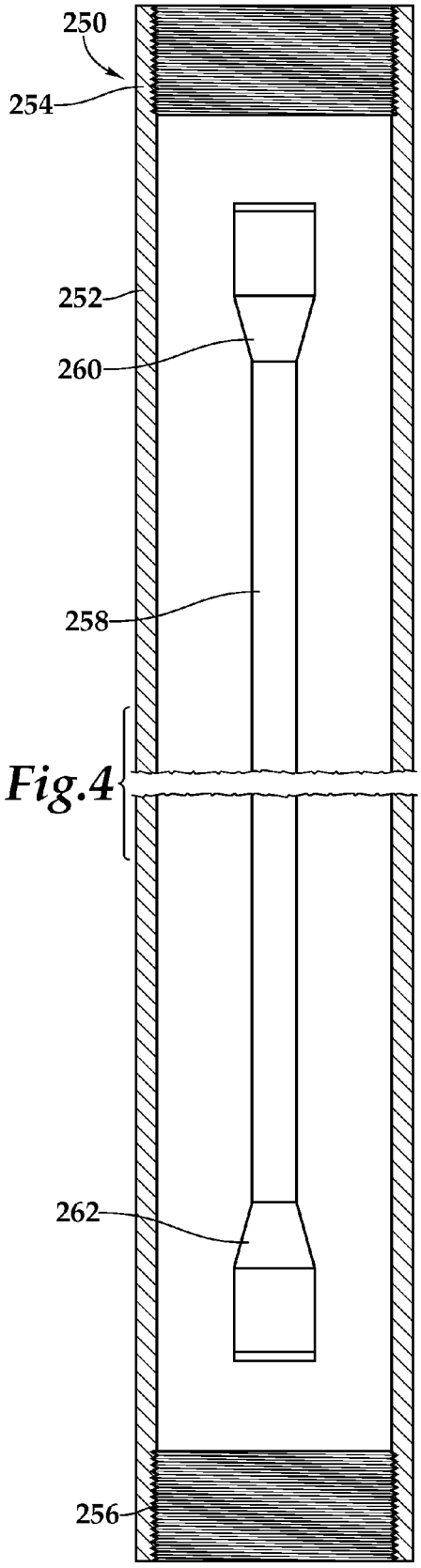
FIG. 4 is a cross sectional view of a slot subassembly for use in a system for circumferentially aligning a downhole latch subsystem in a subterranean well according to an embodiment of the present invention.

Referring next to FIG. 4, one embodiment of a slot subassembly for use in a system for circumferentially aligning a downhole latch subsystem of the present invention is depicted and generally designated 250. Slot subassembly 250 has a generally tubular body 252 including an upper connector 254 and a lower connector 256 suitable for connecting slot subassembly 250 to other tools or tubulars via a threaded connection, a pinned connection or the like. Slot subassembly 250 includes an axially extending internal slot profile 258. In the illustrated embodiment, slot profile 258 includes a tapered upper entry 260 and tapered lower entry 262. Preferably, the circumferentially width of slot profile 258 will substantially match that of the widest orienting key as described in greater detail hereinbelow. The length of slot profile 258 is preferably at least long enough such that at least one of the orienting keys remains within slot profile 258 during alignment operations as described in greater detail hereinbelow.

Figure 5:
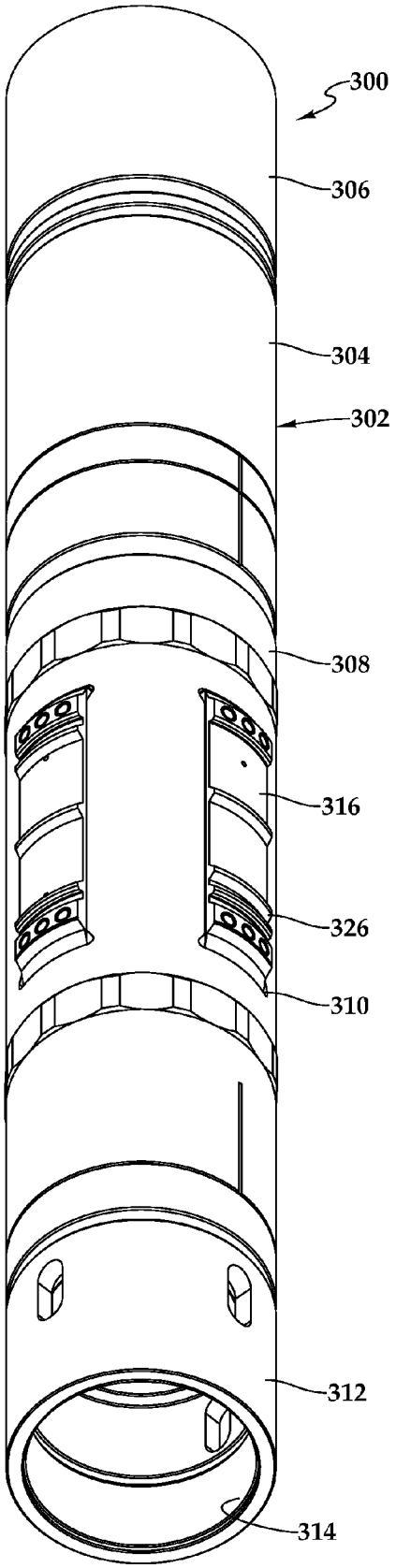
FIG. 5 is a side view of a latch assembly for use in a system for circumferentially aligning a downhole latch subsystem in a subterranean well according to an embodiment of the present invention.
Figure 6:
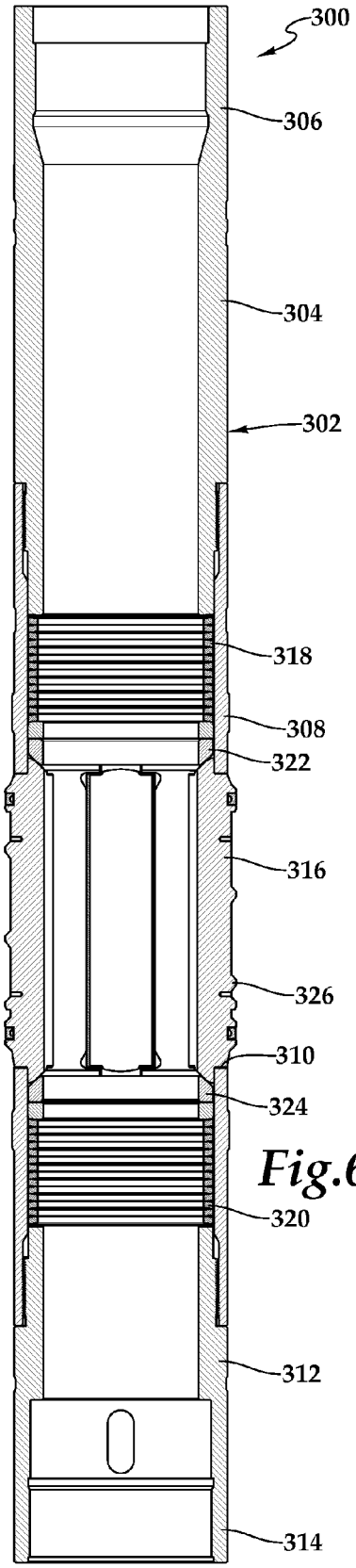
FIG. 6 is a cross sectional view of a latch assembly for use in a system for circumferentially aligning a downhole latch subsystem in a subterranean well according to an embodiment of the present invention.
Figure 7A:
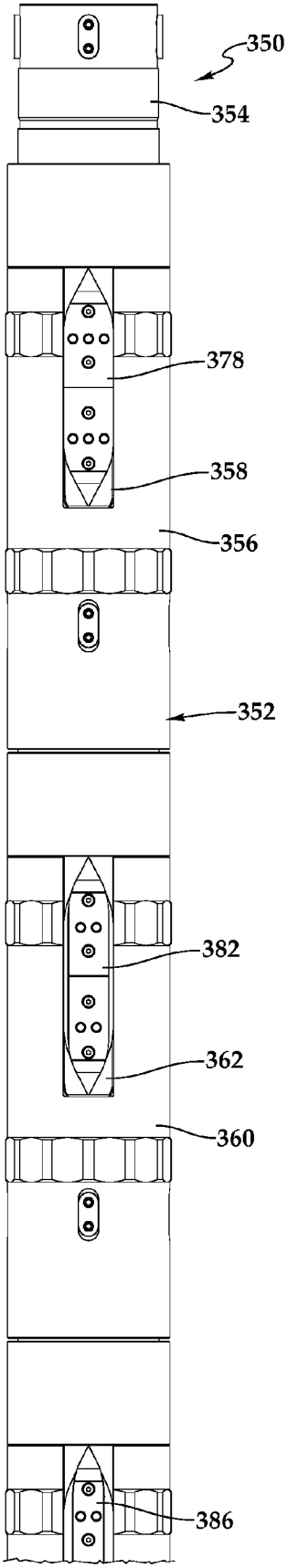
FIGS. 7A-7B are side views of an orienting subassembly for use in a system for circumferentially aligning a downhole latch subsystem in a subterranean well according to an embodiment of the present invention.
Figure 8A:
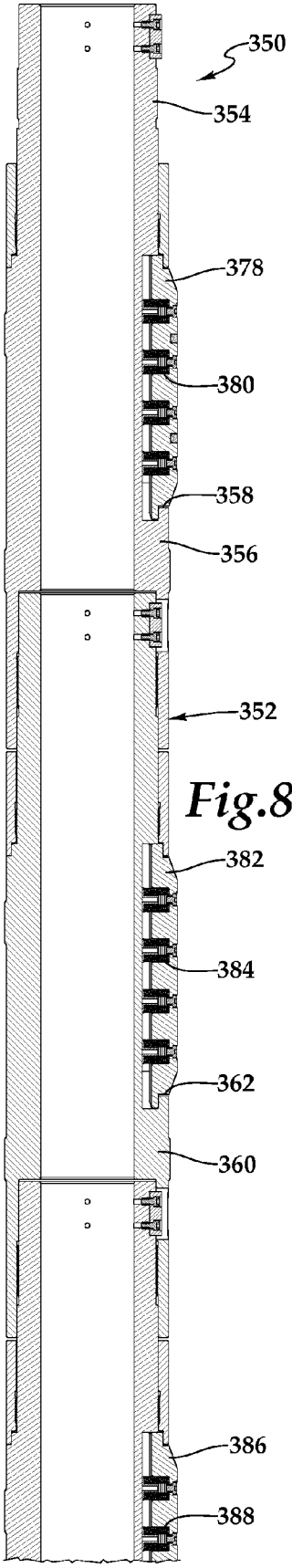
FIGS. 8A-8B are cross sectional views of an orienting subassembly for use in a system for circumferentially aligning a downhole latch subsystem in a subterranean well according to an embodiment of the present invention.
Figure 7B:
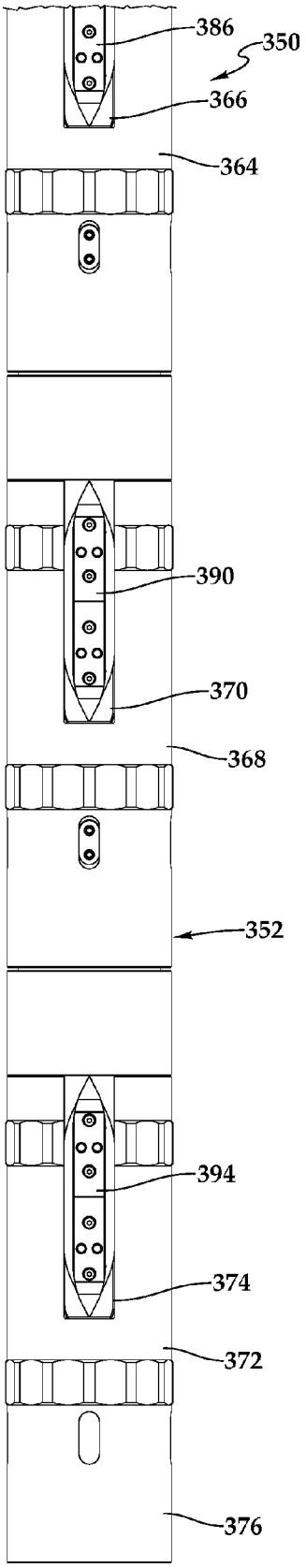
Figure 8B:
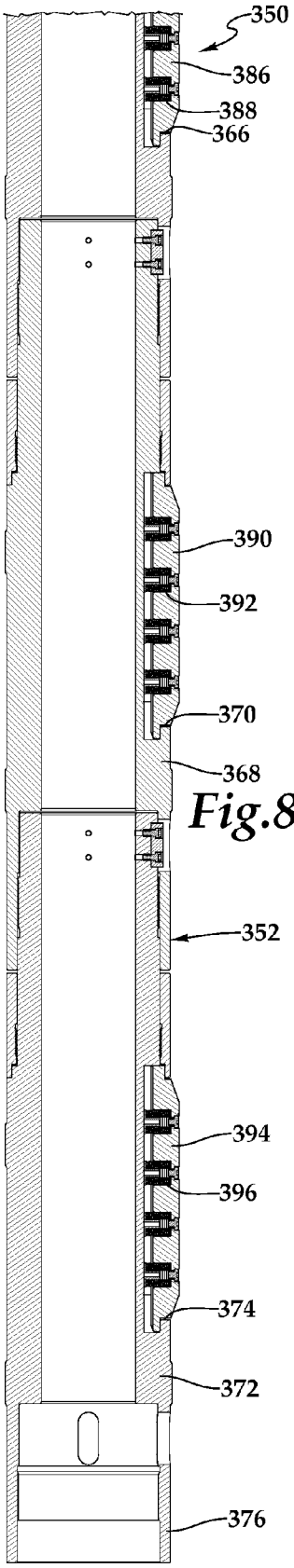

Referring next to FIGS. 5-6, one embodiment of a latch assembly for use in a system for circumferentially aligning a downhole latch subsystem of the present invention is depicted and generally designated 300. Latch assembly 300 has an outer housing 302 including an upper housing 304 having an upper connector 306 suitable for coupling latch assembly 300 to other tools or tubulars via a threaded connection, a pinned connection or the like. Outer housing 302 includes a key housing 308 having four circumferentially distributed, axially extending key windows 310. Outer housing 302 also including a lower housing 312 having a lower connector 314 suitable for coupling latch assembly 300 to other tools or tubulars via a threaded connection, a pinned connection or the like. Disposed within key housing 308 is a plurality of spring operated latch keys 316 that are operable to partially extend through key windows 310. Latch keys 316 are radially outwardly biased by upper and lower Belleville springs 318, 320 that urge upper and lower conical wedges 322, 324 under latch keys 316.

Each of the latch keys 316 has a unique key profile, such as key profile 326, that enables the anchoring and orienting functions of latch assembly 300 with a mating latch coupling having the appropriate latch profile. As illustrated, key profile 326 includes a plurality of radial variations that must correspond with mating radial portions of a latch profile in order for a latch key 316 to operably engage with or snap into that latch profile. In order for each of the latch keys 316 to operably engage with a latch profile, the latch assembly 300 must be properly axially positioned within the mating latch coupling and properly circumferentially oriented within the mating latch coupling. For example, key profile 326 may mate with the portion of latch profile 208 having recesses 230, described above. In this manner, the axial location and circumferential orientation of a device, such as a deflection assembly, that is coupled to or operably associated with latch assembly 300 can be established.

Referring next to FIGS. 7A-8B, one embodiment of an orienting subassembly for use in a system for circumferentially aligning a downhole latch subsystem of the present invention is depicted and generally designated 350. Orienting subassembly 350 has an outer housing 352 including an upper connector 354 suitable for coupling orienting subassembly 350 to other tools or tubulars via a threaded connection, a pinned connection or the like. Outer housing 352 includes an upper key housing 356 having a key window 358, a middle key housing 360 having a key window 362 and three lower key housings 364, 368, 372 having, respectively, key windows 366, 370, 374. Outer housing 352 also including a lower connector 376 suitable for coupling orienting subassembly 350 to other tools or tubulars via a threaded connection, a pinned connection or the like.

Operably associated with upper key housing 356 is a spring operated orienting key 378 that is operable to partially extend through key window 358. Orienting key 378 is radially outwardly biased by a plurality of springs 380 disposed between upper key housing 356 and orienting key 378. Operably associated with middle key housing 360 is a spring operated orienting key 382 that is operable to partially extend through key window 362. Orienting key 382 is radially outwardly biased by a plurality of springs 384 disposed between middle key housing 360 and orienting key 382. Operably associated with lower key housing 364 is a spring operated orienting key 386 that is operable to partially extend through key window 366. Orienting key 386 is radially outwardly biased by a plurality of springs 388 disposed between lower key housing 364 and orienting key 386. Operably associated with lower key housing 368 is a spring operated orienting key 390 that is operable to partially extend through key window 370. Orienting key 390 is radially outwardly biased by a plurality of springs 392 disposed between lower key housing 368 and orienting key 390. Operably associated with lower key housing 372 is a spring operated orienting key 394 that is operable to partially extend through key window 374. Orienting key 394 is radially outwardly biased by a plurality of springs 396 disposed between lower key housing 372 and orienting key 394.

In the illustrated embodiment, each of the lower orienting keys 386, 390, 394 has a first circumferential width, middle orienting key 382 has a second circumferential width and upper orienting key 378 has a third circumferential width. The first circumferential width is less than the second circumferential width and the second circumferential width is less than the third circumferential width. In this manner, the width of the orienting keys becomes progressively larger from lower orienting keys 386, 390, 394 to upper orienting key 378. The benefit of this configuration will be described hereinbelow. In addition, each of the orienting keys 378, 382, 386, 390, 394 has a tapered leading and trailing edge, the benefit of which will be described hereinbelow.

The operation of a system for circumferentially aligning a downhole latch subsystem of the present invention will now be described. An outer tool string including a window joint, a latch coupling and a slot subassembly are interconnected in a casing string and the casing string is run into, for example, the main wellbore. Following completion, if desired, of any zones downhole of the window joint, an inner tool string including a deflection assembly, a latch assembly and an orienting subassembly is run into the casing string. Preferably, the orienting keys of the orienting subassembly are circumferentially aligned with a specific and known latch key of the latch assembly such as the first latch key of the latch assembly. The inner tool string is moved downhole via a conveyance such as a jointed tubing string until the latch assembly is on depth with the latch coupling. This operation is indicated by a weight signal on the surface. The inner tool string is then picked up a predetermined distance such that at least one of the lower orienting keys is axially aligned with the slot profile of the slot subassembly. In this configuration, the inner tool string is rotated within the casing string to rotate the orienting subassembly relative to the slot subassembly until at least one lower orienting key operably engages or snaps into the slot profile.

As described above, as the lower orienting keys have a relatively narrow circumferential width, the at least one lower orienting key axially aligned with the slot profile easily enters the slot profile without interference with the sides of the slot profile even as the inner tool string is rotated. Once at least one of the lower orienting key has operably engaged the slot profile, a torque signal is received at the surface. Due to the relatively long axial length of the orienting keys, the allowable torque between the orienting key or keys of the orienting subassembly and the slot profile of the slot subassembly is much greater than the previously allowable torque between the latch keys of a latch assembly and the latch profile of a latch coupling. As such, the risk of over stressing the latch keys or releasing the latch assembly from the latch coupling during circumferential orientation is alleviated.

When at least one of the lower orienting key has operably engaged the slot profile, coarse circumferential prealignment of the latch keys with the latch profile is achieved and the inner tool string may be moved downhole. As this downhole movement occurs, the middle orienting key enters the slot profile. As the middle orienting key has a circumferential width greater than that of the lower orienting keys, improved circumferential prealignment of the latch keys with the latch profile is achieved. As further downhole movement occurs, the upper orienting key enters the slot profile. As the upper orienting key has a circumferential width greater than that of the middle orienting keys, fine circumferential prealignment of the latch keys with the latch profile is achieved. The tapered leading and trailing edges of the orienting keys as well as the tapered upper entry and lower entry of the slot profile aid in the axial movement of the orienting keys through the slot profile.

Further downhole movement of the inner tool string within the outer tools string axially aligns the latch assembly with the latch coupling. Due to the circumferential prealignment of the latch keys with the latch profile and particularly the fine circumferential prealignment of the latch keys with the latch profile achieved by the upper orienting key in the slot profile, the latch keys operably engage the latch profile with little or no rotation of the inner tool string. In this configuration, the latch keys axially and circumferentially anchor the latch assembly within the latch coupling. Alternatively, the latch keys may axially anchor the latch assembly within the latch coupling while the upper orienting key in the slot profile may provide circumferential anchoring. In either case, when the latch keys of the latch assembly have operably engaged the latch profile of the latch coupling, the deflection assembly is positioned in a desired circumferential orientation relative to the window joint such that a window can be milled, drilled or otherwise formed in window joint in the desired circumferential direction.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for circumferentially aligning a downhole latch subsystem in a wellbore, the system comprising:

an outer tool assembly including a latch coupling having a latch profile and a slot subassembly having an axially extending slot profile; and an elongated inner tool assembly defined along an axis and positionable within the outer tool assembly including a latch assembly having a plurality of latch keys and an orienting subassembly having a plurality orienting keys, wherein at least two orienting keys are axially spaced apart from one another along the inner tool assembly, wherein, after axial alignment of the orienting subassembly with the slot subassembly, rotation of the orienting subassembly causes operable engagement of at least one orienting key with the slot profile and, thereafter, axial alignment of the latch assembly with the latch coupling causes operable engagement of the latch keys with the latch profile.

2. The system as recited in claim 1 wherein the latch coupling and the slot subassembly are coupled together.

3. The system as recited in claim 1 wherein the latch assembly and the orienting subassembly are coupled together.

4. The system as recited in claim 1 wherein the inner tool assembly further includes a deflection assembly.

5. The system as recited in claim 1 wherein a plurality of orienting keys have an axial length longer than a plurality of latch keys.

6. The system as recited in claim 1 wherein at least two of the plurality of axially distributed orienting keys have different circumferential widths.

7. A system for circumferentially aligning a downhole latch subsystem in a wellbore, the system comprising:

an outer tool assembly including a latch coupling having a latch profile and a slot subassembly having an axially extending slot profile; and an inner tool assembly positionable within the outer tool assembly including a latch assembly having a plurality of latch keys and an orienting subassembly having a plurality orienting keys, wherein, after axial alignment of the orienting subassembly with the slot subassembly, rotation of the orienting subassembly causes operable engagement of at least one orienting key with the slot profile and, thereafter, axial alignment of the latch assembly with the latch coupling causes operable engagement of the latch keys with the latch profile, wherein the plurality of orienting keys further comprises a plurality of axially distributed orienting keys.

8. The system as recited in claim 7 wherein at least some of the plurality of axially distributed orienting keys become progressively circumferentially wider from the downhole end to the uphole end of the orienting subassembly.

9. The system as recited in claim 7 wherein at least some of the plurality of axially distributed orienting keys have a tapered leading edge.

10. The system as recited in claim 7 wherein at least some of the plurality of axially distributed orienting keys have a tapered trailing edge.

11. A system for circumferentially aligning a downhole latch subsystem in a wellbore, the system comprising:

an outer tool assembly including a latch coupling having a latch profile and a slot subassembly having an axially extending slot profile; and an elongated inner tool assembly defined along an axis and positionable within the outer tool assembly including a latch assembly having a plurality of latch keys and an orienting subassembly having a plurality orienting keys, wherein at least one of the plurality of axially distributed orienting keys has an edge with a tapering circumferential width, wherein, after axial alignment of the orienting subassembly with the slot subassembly, rotation of the orienting subassembly causes operable engagement of at least one orienting key with the slot profile and, thereafter, axial alignment of the latch assembly with the latch coupling causes operable engagement of the latch keys with the latch profile.

12. The system as recited in claim 11 wherein at least two of the plurality of axially distributed orienting keys have different circumferential widths.

13. The system as recited in claim 11 wherein a plurality of orienting keys have an axial length longer than a plurality of latch keys.

* * * * *